United States Patent [19]

Lindén

[11] 4,024,634

[45] May 24, 1977

[54] FASTENING ARRANGEMENT FOR PLASTICS HANDLES OF SCISSORS AND EQUIVALENT

[75] Inventor: Erkki Olavi Lindén, Billnas, Finland

[73] Assignee: Oy Fiskars AB, Helsinki, Finland

[22] Filed: June 7, 1976

[21] Appl. No.: 693,609

[30] Foreign Application Priority Data

June 11, 1975 Finland ..... 751742

[52] U.S. Cl. ..... 30/341

[51] Int. Cl.[2] ..... B26B 13/20

[58] Field of Search ..... 30/254, 341, 343, 257

[56] References Cited

UNITED STATES PATENTS

| | | | |
|---|---|---|---|
| 2,557,553 | 6/1951 | Metzger | 30/341 X |
| 3,987,542 | 10/1976 | Visco | 30/257 |

FOREIGN PATENTS OR APPLICATIONS

| | | | |
|---|---|---|---|
| 774,767 | 5/1957 | United Kingdom | 30/341 |
| 640,754 | 7/1950 | United Kingdom | 30/341 |

*Primary Examiner*—Al Lawrence Smith
*Assistant Examiner*—J. C. Peters
*Attorney, Agent, or Firm*—Ladas, Parry, Von Gehr, Goldsmith & Deschamps

[57] ABSTRACT

A fastening arrangement for plastics handles of scissors and equivalent in constructions in which the plastics handle is die-cast around a tang at the end of the blade-shaft. The tang has such a generally curved shape that on the outside of the blade-shaft there will be a rather thick plastics layer at the end of the tang, and, correspondingly, on the inside of the blade-shaft there will be a rather thick plastics layer at the root end of the tang.

2 Claims, 8 Drawing Figures

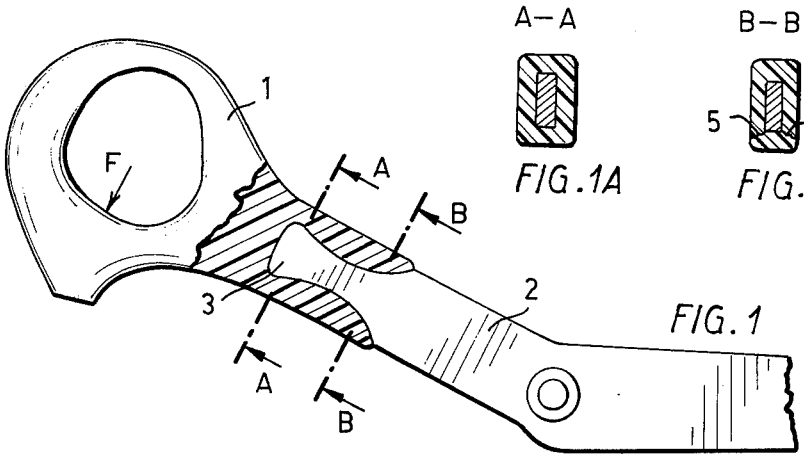
FIG. 1A
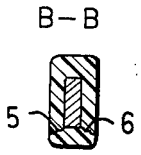
FIG. 1B
FIG. 1
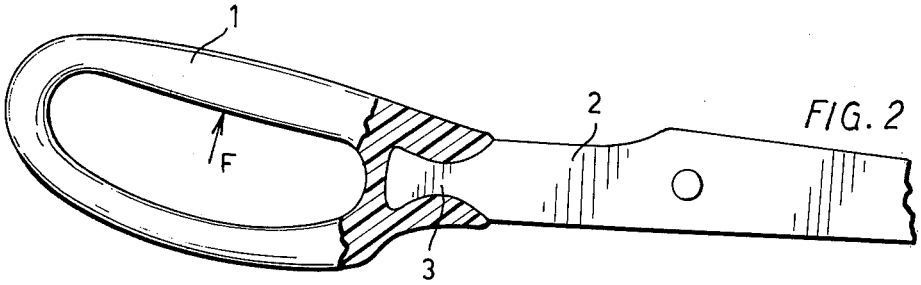
FIG. 2
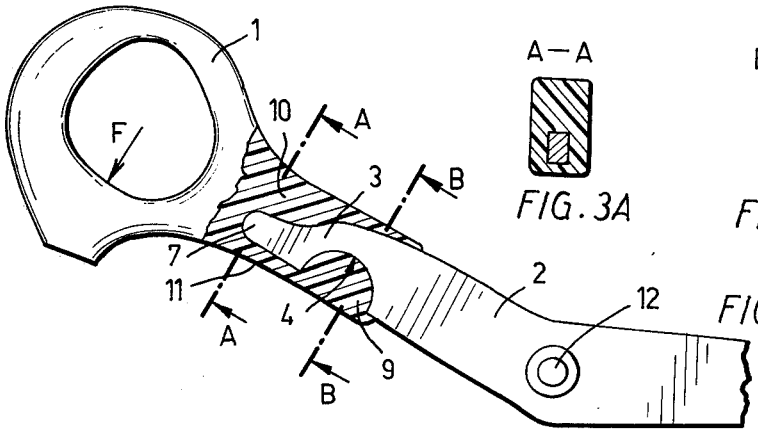
FIG. 3A
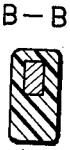
FIG. 3B
FIG. 3
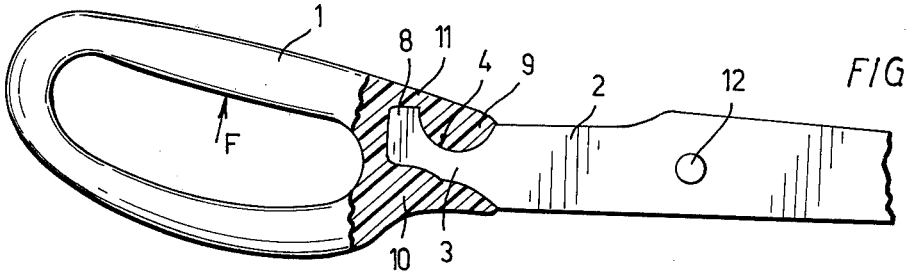
FIG. 4

FASTENING ARRANGEMENT FOR PLASTICS HANDLES OF SCISSORS AND EQUIVALENT

The present invention concerns a fastening arrangement for plastics handles in cutting tools, such as scissors and pliers, comprising two blade-shafts pivotably fastened to each other, the handles being die-cast around the end portion of the blade-shafts, the arrangement comprising a tang forming said end portion of each blade-shaft and having such a generally curved shape.

In scissors of this type, the plastics handles are die-cast in a mould around a tang at the end of the blade-shaft. Previously, an arrangement was used in which the joint was approximately symmetrical in relation to the longitudinal axis of the blade shaft. A drawback with this arrangement was that handles were broken in heavy use.

BRIEF DESCRIPTION OF THE DRAWINGS.

FIG. 1 shows an earlier fastening arrangement, partly in section.

FIGS. 1A and 1B are cross sections taken at A—A and B—B of FIG. 1.

FIG. 2 shows another earlier fastening arrangement, partly in section.

FIG. 3 shows one embodiment of the fastening arrangement in accordance with the invention, partly in section.

FIGS. 3A and 3B are cross sections taken at A—A and B—B of FIG. 3.

FIG. 4 shows another embodiment of the fastening arrangement in accordance with the invention, partly in section.

To begin with, let us have a somewhat closer look at the earlier solution of said type. Such a solution is presented in FIGS. 1 and 2 of the attached drawings, which show a commonly used fastening arrangement, partly in section. Here, the fastening of both handles 1 of the scissor halves to the blade-shaft 2 is accomplished by using an almost similar symmetric tang 3. This tang is expanded at its outer and so as to improve the holding quality. During shearing, the effective force acts in the direction of the arrow F. Then, at the section A—A, bending arises, but so that a tensile force is produced only above the tang 3 (FIG. 1). The end of the tang 3 is expanded so much that the plastic layer at this point is quite thin. In this case, for example at points 5 and 6, a high tension is produced (section B—B).

The object of the present invention is to eliminate the drawback presented above and to provide a fastening arrangement of a novel type.

The fastening arrangement in accordance with the invention is mainly characterized in that on the outside of the blade-shaft there will be a rather thick plastics layer at the outer end of the tang, and, correspondingly, on the inside of the blade-shaft there will be a rather thick plastics layer at the root end of the tang.

Particular embodiments of the fastening arrangement in accordance with the invention are defined in claims 2 to 5.

By means of the invention, remarkable advantages are obtained. Thus, the arrangement produces a remarkable improvement in the firmness of the joint between the plastics and the blade-shaft. In fact, with static loading, the new solution does not display a major difference in strength as compared with the earlier solution. Both the old and the new solution stand a load of 70 to 80 kg under the same circumstances. But, on the contrary, when the handles are loaded dynamically, as is done in normal use, the difference is, however, considerable. For example, if the load is 20 kg and the frequency 3 cycles per second, it has been established that the ratio of the times of durability is about 10 to 1 in favour of the new solution. When the load is reduced, this ratio becomes even higher. It should be mentioned that when shearing with scissors, the maximum force attainable is about 15 kg.

The invention will be examined below in more detail, reference being made to FIGS. 3 and 4 in the attached drawings.

FIG. 3 shows one embodiment of the fastening arrangement in accordance with the invention, partly in section.

FIG. 4 shows another embodiment of the fastening arrangement in accordance with the invention, partly in section.

As the solutions of FIG. 4 are highly similar and as they can, moreover, be included in the same construction of scissors, they will be described below simultaneously. The tang 3 has such an asymmetric design that it is, in principle, curved whereby the concave side 4 of the curve points in the direction of the force F. Thus, on the other, convex side of the tang 3, a layer of plastics 10 is left over whose thickness varies so that at the outer end 7,8 of the tang 3 there is a maximum quantity of plastics in the direction of the force F. When moving along the outer edge of the blade-shaft 2 outwards, the outer side of the tang 3 becomes almost evenly more distant from the direction of the outer edge of the blade-shaft 2 so that the layer 10 of plastics lying against the outer side 3 of the tang is in this example case approximately triangular as to its shape.

Correspondingly, at the position of the tang 3 where the plastics of the handle 1 ends, there is a notch 4 opening in the direction of the force F so that at the inner edge of the blade-shaft 2 of the scissors, i.e. relatively close to the pivot axis 12 of the scissors, there is a rather thick layer 9 of plastics. On the contrary, closer to the outer end 7, 8 of the tang 3, the thickness 11 of the plastics at the inner edge of the blade-shaft 2 may be quite thin.

The cross-section of the notch 4 may, in principle, be of several different shapes, e.g. V or U shaped, angular or polygonal. However, the semicircular notch 4 as shown in FIGS. 3 and 4 provides the advantage that it is production-technically the most advantageous one, for example, when the blanks are cut (circular punch), when the objects are fastened at the different stages of production, and when the plastics is die-cast. For, during die-casting, the casting position is placed so that the plastics jet meets the bottom of the notch and that the filling of the mould takes place in a favourable manner. For, as regards the resistance to fatigue of plastics, the direction of the molecular chains has a great significance.

The solution of FIG. 3 differs from that of FIG. 4, in principle, only in the respect that in the former solution, owing to the small size of the loop portion of the handle 1, the tang 3 may extend axially as a lengthy tip 7 into the plastics, whereas in the latter case the tip of the tang 3 is cut and designed as a hook-shaped nose 8.

By shaping the tang in accordance with the principles presented above, it has been possible to place a large quantity of plastics at the positions at which the effective shear forces are largest, and the increase in the resistance to dynamic strain is even surprisingly high.

It is clear that the solution in accordance with the invention can, besides scissors, be used, for example, in garden scissors, pliers and other similar tools in which plastics handles are at their fastening points subjected to relatively high shear forces.

I claim:

1. A fastening arrangement for plastics handles in cutting tools, such as scissors and pliers, comprising two blade-shafts pivotably fastened to each other, the handles being die-cast around the end portion of the blade-shafts, the arrangement comprising a tang forming said end portion of each blade-shaft and formed at its root end with a notch at the inner edge of the blade-shaft, which notch is filled with plastics to procide a relatively thick plastics layer on the inside of the blade-shaft at the root end of the tang, and said tang being generally curved so that the surface of the tang at the outer edge of the blade-shaft becomes progressively more distant from the direction of said outer edge so as to provide an approximately triangular plastics layer on the outside of the tang, said triangular plastics layer being of greater thickness at the outer end of the tang than at the root end thereof.

2. A fastening arrangement as claimed in claim 1, wherein the cross-section of the notch is of a semicircular shape.

* * * * *